United States Patent [19]

Long

[11] 4,357,787

[45] Nov. 9, 1982

[54] SPINDLE FOR CAPPING MACHINE

[75] Inventor: Charles N. Long, Buffalo, N.Y.

[73] Assignee: A-T-O Inc., Willoughby, Ohio

[21] Appl. No.: 154,531

[22] Filed: May 30, 1980

[51] Int. Cl.[3] ..... B65B 7/28; B67B 1/06

[52] U.S. Cl. ..... 53/317; 53/272; 53/331.5; 53/368

[58] Field of Search ..... 53/272, 276, 306, 308, 53/317, 331.5, 368, 490

[56] References Cited

U.S. PATENT DOCUMENTS

| | | | |
|---|---|---|---|
| 2,684,141 | 7/1954 | Pim | 53/317 |
| 3,242,632 | 3/1966 | Dimond | 53/67 |
| 3,537,231 | 11/1970 | Dimond | 53/317 X |
| 4,089,153 | 5/1978 | Long | 53/331.5 |

*Primary Examiner*—John Sipos
*Assistant Examiner*—Charles L. Willis
*Attorney, Agent, or Firm*—Christel, Bean & Linihan

[57] ABSTRACT

A container capping apparatus having a generally vertical tubular spindle carrying a cap holding chuck assembly is rotatable about its axis to apply a screw cap to a container with predetermined force. A control rod is vertically movable within the spindle against an actuator spring to release the applied cap from the chuck. An axle carried by the control rod projects through vertically elongated slots in opposite sides of the spindle, and is received in a control collar slidable on the spindle. A cam follower is carried by a yoke vertically slidable on the spindle and an external adjusting nut is carried by the yoke for movement therewith in operative engagement with the collar. The vertical position of the nut relative to the yoke is selectively adjustable, thereby to adjust the position of the control rod relative to the cam follower.

7 Claims, 5 Drawing Figures

SPINDLE FOR CAPPING MACHINE

BACKGROUND OF THE INVENTION

This invention relates to container capping machines and more particularly to apparatus for applying screw caps to containers. This invention is an improvement over the machine shown in U.S. Pat. No. 4,089,153 dated May 16, 1978 and issued in my name to the assignee of this application.

Capping machines of this type include a plurality of spindles each carrying a cap applying chuck, the spindles being rotated for applying screw caps with predetermined torque. Once the cap has been applied, a control rod is actuated to open the chuck jaws and release the cap. The relative position of the control rod within the spindle is critical to proper operation of the cap releasing mechanism. To accommodate manufacturing tolerances and variations in container height it is important that the relative position of the control rod be selectively adjustable, and it is highly desirable that such adjustment be made quickly, easily and with whatever tools may be readily available.

SUMMARY OF THE INVENTION

The primary object of this invention is to provide a capping machine control rod adjustment which is external of the spindle and readily accessible to the operator, and which is conveniently actuated by any appropriate tool, thereby facilitating individual control rod adjustment with a minimum of time and effort.

The foregoing is accomplished with this invention by providing an external adjusting nut defining the inward limit of movement of the control rod, the nut being rotatable on the spindle relative to the cam follower which causes the control rod to be extended to release a cap, and which can be rotated by any suitable convenient type of tool.

The foregoing and other objects, advantages and characterizing features of this invention will become clearly apparent from the ensuing detailed description of an illustrative embodiment thereof, reference being made to the accompanying drawing wherein like reference numerals denote like parts throughout the various views.

BRIEF DESCRIPTION OF THE DRAWING FIGURES

DESCRIPTION OF THE ILLUSTRATED EMBODIMENT

Figures 1, 2, 3, 4, 5:
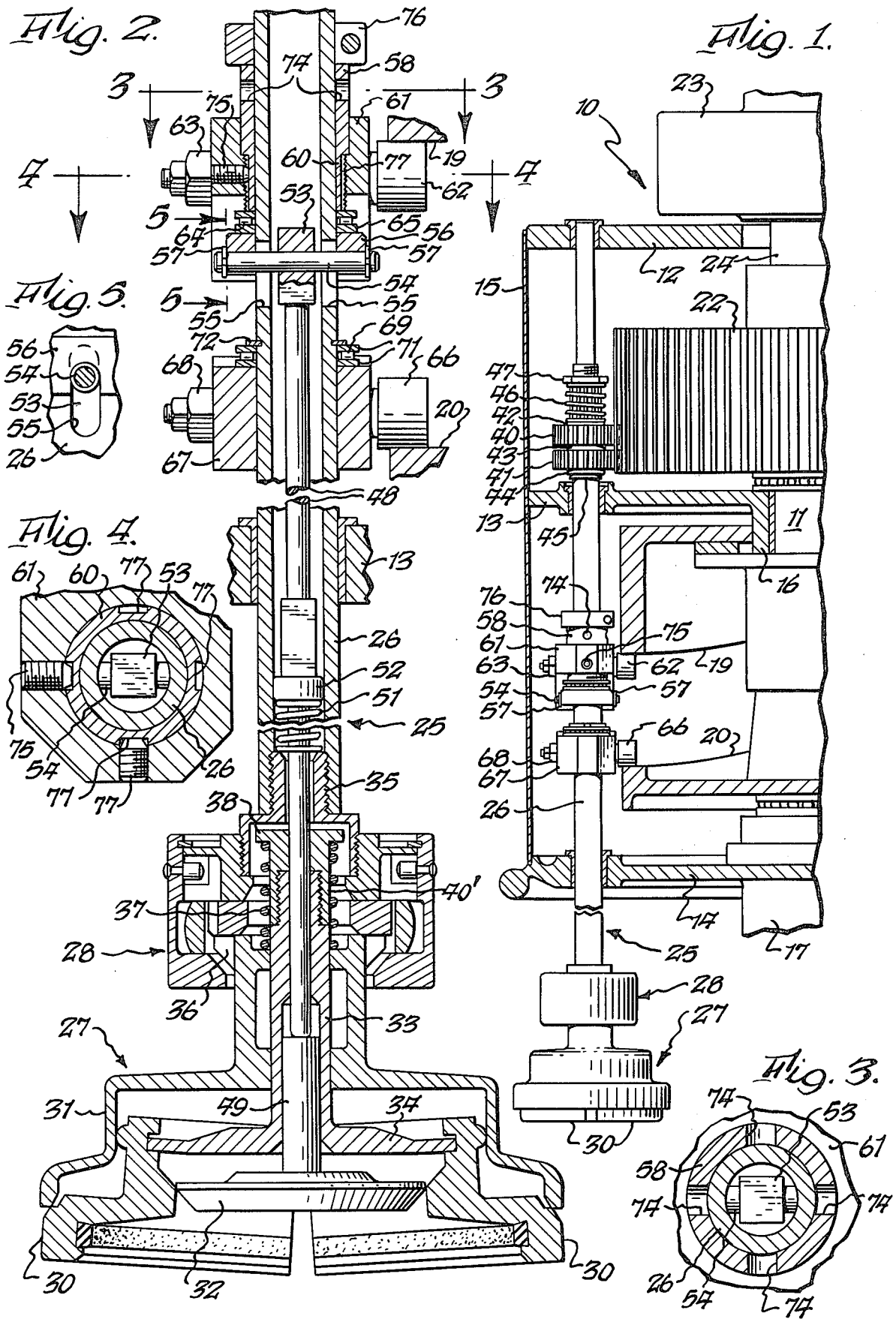
FIG. 1 is a general assembly view of a turret and a capping spindle incorporating the adjustment of this invention, partly in side elevation and partly in vertical section through the turret axis, the turret being broken away for convenience in illustration.
FIG. 2 is a vertical sectional view of the spindle, on an enlarged scale, the upper end of the spindle being broken away and certain associated parts being fragmentarily shown for convenience in illustration.
FIG. 3 is a horizontal sectional view thereof taken about on line 3—3 of FIG. 2.
FIG. 4 is a horizontal sectional view thereof taken about on line 4—4 of FIG. 2.
FIG. 5 is a fragmentary side elevational view thereof, partly in section, taken about on line 5—5 of FIG. 2.

The construction and operation of the turret which supports the capping spindles is generally the same in principle as the corresponding turret shown and described in U.S. Pat. No. 4,089,153, and in greater detail in patents to George H. Dimond U.S. Pat. Nos. 3,242,632 dated Mar. 29, 1966 and 3,537,231 dated Nov. 3, 1970. Accordingly, the turret will be described only in general terms herein.

The turret structure, generally designated 10, is mounted upon a fixed central column or post 11 and comprises a top plate 12, an intermediate plate 13, and a bottom plate 14, all of which are enclosed by a cylindrical casing 15.

Intermediate plate 13 and bottom plate 14 are provided with suitable bearing formations 16 and 17, respectively, for rotatably mounting the turret on stationary post 11. The drive for rotating turret 10 is conventional and therefore is not shown. Such drive may comprise a worm gear drive at the lower end of bearing 17, as illustrated and described in the two Dimond patents referred to above. Upper and lower stationary cam members 19 and 20 are fixed to the central supporting post 11.

A bull gear 22 from which the several spindles are rotated is normally stationary, but may be rotated in either direction by a variable drive mechanism 23 for increasing or decreasing the rotational speed of the capping spindles. Variable drive 23 is connected to bull gear 22 by a sleeve shaft 24 which is rotatable about a reduced diameter, upper portion of the central supporting shaft 11. The variable drive 23 corresponds to the mechanism shown at 300 in FIG. 2 of Dimond U.S. Pat. No. 3,242,632 and at 214 in FIG. 4 of Dimond U.S. Pat. No. 3,537,231.

Top, intermediate and bottom plates 12, 13 and 14 of turret 10 are connected and reinforced by several tie rods, not shown, in a manner well understood in the art. The foregoing is believed sufficient to illustrate the type of conventional turret structure with which the spindles incorporating the adjustment of this invention are used.

A plurality of capping spindles are carried by turret 10 for movement therewith about the axis of column 11, one such spindle, generally designated 25, being shown in FIG. 1, and in greater detail in FIG. 2. Except for the control rod adjustment, spindle 25 is like that shown at 30 in my U.S. Pat. No. 4,089,153, incorporated herein by reference. Spindle 25 comprises a tubular member 26 suitably journalled in plates 12, 13 and 14 of turret 10 for rotation about the spindle axis and for vertical sliding movement relative to the plates under control of the stationary cam 20.

At its lower end, spindle 25 carries a chuck assembly generally designated 27 which is coupled to spindle member 26 by a connecting device generally designated 28 between the lower end of spindle member 26 and the upper end of chuck assembly 27. The chuck assembly includes jaws 30 adapted to grip a cap for applying it to a container, a chuck bell 31, a chuck actuator or stripper 32 and a sleeve 33 terminating at its lower end in a radially extending flange 34 which serves as a pivot for jaws 30. The manner in which chucks of this general type are constructed and operate are well known in the capping art, and requires no further description.

The coupling 28 is attached to the lower end of spindle member 26 by an externally threaded, cup shaped member 35, threaded in the lower end of member 26 and the upper end of coupling 28. Bell 31 of chuck 27 has a bayonet joint connection with coupling 28, as indicated at 36. The construction and operation of this connector or coupling 28 is more fully shown and described in U.S. Pat. No. 3,031,822 dated May 21, 1962 in the name of George H. Dimond (coupling mechanism 22) and in Dimond U.S. Pat. No. 3,242,632. Sleeve 33 is normally urged in an upward direction by a compression coil spring 37 which acts between the upper end of bell 31 and a flange 38 at the upper end of sleeve 33.

As described in my earlier U.S. Pat. No. 4,089,153, each spindle 25 is rotated about its axis, as it moves with the turret about the turret axis. This is accomplished by a pair of pinions 40 and 41 which mesh with the normally stationary bull gear 22, whereby the pinions 40 and 41 are rotated as the spindles revolve about the bull gear. Friction drive washers 42, 43 and 44 lie, respectively, above, between and below pinions 40 and 41, and are keyed to the spindle casing 26. Pinions 40 and 41 are rotatable about casing 26. The lower washer 44 seats against a locking collar 45 and the radially engaging faces of washer 42, pinion 40 and washer 43, and of washer 43, pinion 41 and washer 44, are held engaged by a compression coil spring 46 which seats against the upper washer 42 and is held in place by an adjustable spring nut 47, thereby applying a predetermined spring force against the stacked pinions 40, 41 and washers 42–44 whereby normally the rotating pinions 40, 41 cause the spindle to rotate as it is moved around the turret axis. However, once a cap has been screwed onto the container with a predetermined torque, the friction between the pinions and washers will be insufficient to overcome that torque, permitting the washers to slip relative to the pinions and thereby stop rotation of the spindle when the desired torque action has been obtained. All of this is fully disclosed and described in my aforesaid patent and requires no further description here.

Stripper 32 is actuated by a control rod 48 which extends axially within the tubular spindle casing 26, through the member 35 and sleeve 33 for engagement against the upstanding stem 49 of stripper 32. An acutator spring 51 surrounds control rod 48, extending between a collar 52 on the control rod and the shoulder or ledge provided by the upper end of member 35, as clearly shown in FIG. 2.

At its upper end, control rod 48 has an apertured portion 53 which receives an axle 54 extending through the apertured end portion 53 and through vertically elongated slots 55 through the wall of spindle casing 26 on diametrically opposite sides thereof. Axle 54 is received in diametrically opposed, generally semi-circular recesses formed in the lower edge of a control collar 56, the axle being held against lateral displacement by retaining rings 57. An adjusting nut 58 is rotatable and axially slidable on spindle casing 26, and has an externally threaded shank 60 received in a yoke 61 which carries a cam roll follower 62 secured to the yoke by a suitable nut 63. A thrust bearing 64 is interposed between a pair of thrust washers 65, the bearing and washers being positioned between the lower end of adjusting nut 58 and the upper surface of control collar 56. In this way, actuating spring 51 urges control rod 48 upwardly, to a retracted position, resiliently urging collar 56 against the thrust bearing-washer assembly beneath adjusting nut 58 and thereby urging follower 62 against the control rod actuating cam 19. A locking collar 76 limits upward movement of nut 58 on spindle casing 26.

A cam roll follower 66 is carried by a yoke 67, being secured thereto by a nut 68. A thrust bearing 69 is interposed between a pair of thrust washers 71 and this thrust washer-bearing assembly is interposed between the upper surface of yoke 67 and a retaining ring 72 which limits upward movement of yoke 67 relative to spindle casing 26.

Thus actuating spring 51, in addition to urging follower 62 against cam 19, also acts through member 35, casing 26 and retaining ring 72 to urge follower 66 against cam 20, whereby the followers 62 and 66 are maintained in engagement with the respective cam 19 and 20 to follow the profiles thereof. The weight of spindle 25 also aids in maintaining follower 66 engaged against cam 20.

In operation, as spindle 25 is rotated about the turret axis, pinions 40 and 41 rotate spindle 25 about its axis as previously described. The spindle is lowered to pick up a cap and then raised, under control of cam 20, in a manner well known in the art, and thereafter lowered to apply the cap to a container with a predetermined torque as determined by the spring 46 and the drive friction force produced thereby. This can be varied by adjusting the position of nut 47. Once the cap has been applied with a predetermined force, the profile of cam 19 is such as to cause follower 62 to move downwardly, taking with it yoke 61, adjusting nut 58, control collar 56, axle 54 and control rod 48, shifting the latter axially downwardly with the spindle to an extended position. During such extension movement control rod 48 moves stripper 32 to the position shown in FIG. 2, opening jaws 30 and releasing the cap. The profile of cam 20 thereafter rises, acting through follower 66 to raise spindle 25 to repeat the sequence of operations. All of this is understood in the art, and reference is made to Dimond U.S. Pat. No. 3,537,231 with respect to the sequence of movements.

It is important that the position of control rod 48 relative to the control rod cam profile 19 be properly adjusted, to accommodate both manufacturing tolerances and variations in container height. That is accomplished quickly and easily with the adjustment mechanism of this invention, because all that is required is to rotate adjusting nut 58 relative to spindle casing 26 and yoke 61. Adjusting nut 58 is located externally of the spindle, where it is readily and directly accessable, and is provided with openings 74 at 90 degree intervals around the nut, to receive a rod, an allen wrench or any suitable tool for the purpose of rotating nut 58 relative to yoke 61. As nut 58 is rotated, yoke 61 is moved axially of spindle casing 26 to vary the position of control collar 56 and control rod 48 relative to cam follower 62 and cam 19. Once the proper relative position of control rod 48 within the spindle is obtained, the parts are secured in adjusted position by set screws 75 which releasably lock nut 58 and yoke 61, the former having set screw receiving lands 77.

Obviously the external surface of that portion of nut 58 which projects above spindle 61 can be flat sided or otherwise configured, to accommodate various types of tools for the purpose of rotating the nut once set screws 75 have been loosened, to selectively adjust the fully retracted position of control rod 48 relative to control cam 19. Nut 58 is stepped to provide the reduced diameter shanks 60, and the bore of yoke 61 is similarly stepped to receive nut 58. Yoke 61 is held against rotation, and nut 58 bears against collar 76 as it is rotated.

It will be appreciated that yokes 61 and 67 can be shaped like yokes 56 and 71 of my U.S. Pat. No. 4,089,153, and are supported on appropriate auxiliary spindles, which can be carried by the turret plates in a manner well understood in the art.

Accordingly, it is seen that this invention fully accomplishes its intended objects, providing a control rod adjustment which is readily accessible and quickly and conveniently manipulated to obtain the desired adjustment. While only one embodiment has been disclosed and described in detail, that is done by way of illustration and without thought of limitation, and it will be appreciated that the control rod adjustment of this invention can have utility in capping apparatus other than the specific mechanism disclosed herein.

What is claimed is:

1. In a container capping apparatus of the type having a generally vertical tubular spindle rotatable about its axis and carrying a cap holding chuck assembly at its lower end, drive means for rotating said spindle to apply a screw cap to a container, a control rod vertically movable within said spindle for releasing a cap from said assembly, spring means normally urging said control rod in one direction within said spindle, cam controlled means for moving said rod in the opposite direction to release a cap from said assembly, said cam controlled means including a cam follower carried by a yoke vertically movable relative to said spindle, and adjustable means limiting movement of said control rod in said one direction relative to said cam follower, the improvement comprising:

(a) an axle carried by said control rod and projecting through vertically elongated slots in opposite sides of said spindle;

(b) means to transmit thrust from said yoke to said axle in a direction parallel to the axis of said spindle; and (c) an adjusting nut external relative to and coaxial with said spindle and carried by said yoke for movement therewith relative to said spindle, said nut limiting movement of said axle in an axial direction relative to said spindle, and the vertical position of said nut relative to said yoke being selectively adjustable, thereby to adjust the upper limit of movement of said control rod relative to said follower.

2. Container capping apparatus as set forth in claim 1, together with a control collar slidable on said spindle receiving and retaining said axle, said nut having operative engagement with said collar.

3. Container capping apparatus as set forth in claim 2, a thrust bearing between a pair of thrust washers being interposed between said adjusting nut and the upper surface of said control collar, the lower surface of said control collar being recessed to receive and retain said axle.

4. Container capping apparatus as set forth in claim 1, said adjusting nut being partially threaded within said yoke, and having means for releasably retaining said nut in adjusted position.

5. Container capping apparatus as set forth in claim 4, said retaining means comprising a set screw carried by said yoke.

6. Container capping apparatus as set forth in claim 1, said adjusting nut having tool receiving means for selectively rotating said nut in opposite directions relative to said yoke.

7. Container capping apparatus as set forth in claim 1, said control rod having a collar intermediate the ends thereof, and said apparatus including a member having threaded engagement with the lower end of said spindle and providing a ledge therein, said spring means being confined within the lower end portion of said spindle between said rod collar and said ledge.

* * * * *